United States Patent [19]

Ayre, Jr.

[11] Patent Number: 4,664,377

[45] Date of Patent: May 12, 1987

[54] BOWLING ALLEY

[76] Inventor: Fred P. Ayre, Jr., 321 E. Fairview St., Bethlehem, Pa. 18017

[21] Appl. No.: 808,601

[22] Filed: Dec. 13, 1985

[51] Int. Cl.[4] ..... A63D 1/04

[52] U.S. Cl. ..... 273/51

[58] Field of Search ..... 273/51; 52/126.1, 573, 52/586

[56] References Cited

U.S. PATENT DOCUMENTS

| | | | |
|---|---|---|---|
| 359,542 | 3/1887 | Reisky | 273/51 |
| 469,071 | 2/1892 | Warth | 273/51 |
| 471,244 | 3/1892 | Montgomery | 273/51 |
| 490,916 | 1/1893 | Montgomery | 273/51 |
| 631,090 | 8/1899 | Mussey | 273/51 |
| 757,922 | 4/1904 | Herbst | 273/51 |
| 1,511,696 | 10/1924 | Wendt | 273/51 |
| 1,697,800 | 1/1929 | Treiber | 273/51 |
| 1,795,624 | 3/1931 | Treiber | 273/51 |
| 1,921,734 | 8/1933 | Dunlap | 273/51 |
| 2,203,458 | 6/1940 | Federer | 273/51 |
| 2,788,973 | 4/1957 | Grawey | 273/51 |
| 2,946,590 | 7/1960 | Bruner | 273/51 X |
| 2,969,983 | 1/1961 | De Vore | 273/51 |
| 3,014,722 | 12/1961 | Green | 273/51 |
| 4,146,223 | 3/1979 | Stottman | 273/51 |
| 4,269,411 | 5/1981 | Heddon | 273/51 |
| 4,354,678 | 10/1982 | Heddon | 273/51 |
| 4,406,455 | 9/1983 | Berry | 273/51 |

*Primary Examiner*—Anton O. Oechsle

*Attorney, Agent, or Firm*—William H. Eilberg

[57] ABSTRACT

This invention discloses an improved bowling alley which lasts at least twice as long as bowling alleys of the prior art. The bowling alley has a bowling lane defined by a plurality of staggered boards, the boards being held tightly together between a pair of holding means, or equivalent devices. The holding means are provided with at least one resilient member which allows the boards to expand and contract, in response to changes in the moisture content, without forming gaps between the boards. At least one strain gauge is also provided on at least some of the holding means, enabling measurement of the amount of expansion of the lane, and thereby providing an indication of whether the boards need humidification or dehumidification. The bowling lane is supported by a plurality of posts, the posts including threaded members which permit the height of the lane to be finely adjusted. The region beneath the lane is hollow and insulated, and is provided with air conditioning and humidifying devices which can raise or lower the moisture content of the wood, as required.

29 Claims, 8 Drawing Figures

BOWLING ALLEY

BACKGROUND OF THE INVENTION

The present invention relates to the field of bowling alleys, and discloses a structure which has a longer useful life than any of the bowling alleys of the prior art.

Bowling alleys generally include lanes formed from a large number of narrow boards, the boards being held firmly together to define the bowling surface. A typical bowling lane is constructed of boards having a width of approximately one inch, and a regulation bowling lane is about 41.5 inches wide. Generally, the boards forming the first fifteen feet of the lane are made of hard maple, with the balance of the boards of the lane being constructed of long leaf yellow pine. In this specification, the term "lane" will be used to refer to the bowling surface, i.e. the boards described above, and the term "alley" will be used to refer to the entire structure, including the support means for the lane.

Bowling alleys having lanes formed of a plurality of narrow boards have been known for many years. One example of such an alley is shown in U.S. Pat. No. 631,090. The latter patent shows a group of boards or strips, interlocked with each other by a tongue-and-groove construction, and held firmly together by a series of metallic clamps. A similar idea is shown in U.S. Pat. No. 1,697,800, which also provides some vertical adjustability of the bowling surface, through the use of screws located below the surface. U.S. Pat. No. 1,795,624 also discloses a bowling alley constructed from a plurality of narrow boards. And U.S. Pat. No. 1,511,696 discloses still another bowling alley of the same general type, the boards of the bowling lane being held together by a combination of bolts and nails.

One major problem in the maintenance of bowling alleys results from the fact that wood absorbs moisture. As the boards forming the bowling lane absorb moisture from the surrounding air, they expand, especially in the transverse direction. The boards later contract when the humidity decreases. If the boards are nailed in place, as is true with most of the bowling lanes presently in use, the expansion causes the boards to separate, forming gaps between adjacent boards. Then, when a bowling ball strikes an edge of one of these boards, a piece of the wood is likely to chip off. This process of chipping is known as "feathering". Feathering can ruin a bowling lane in a relatively short time. The lane is left with crevices, pock marks, and generally undesirable surface features. This damage is quite apparent, even to the untrained eye.

Even if the boards of the lane are not nailed in place, absorption of moisture can be problematic. Expansion of the boards can cause the lane to break the clamp, or other holding device, which presses the boards together. And if the clamp does not break, then the edge of the lane may buckle, to accommodate the extra pressure, creating an unwanted slant in the lane surface. Also, the boards may be compressed beyond their elastic limit, so that gaps will form when the humidity is reduced. Such gaps in the lane are likely to cause feathering, as described above.

The issue of damage to a bowling lane due to expansion and contraction of the boards is not just an aesthetic problem. A bowling lane having visible gaps is likely to cause unpredictable and unwanted irregularities in the motion of the bowling ball. Bowling alleys are precisely crafted structures which must meet the standards set by the American Bowling Congress (ABC), which annually inspects bowling alleys throughout the country. If an alley does not pass the inspection, the alley cannot be used for official league and tournament play. Among many other items, an ABC inspection includes an examination of the surfaces of each lane. A spirit level is used to check for crosswise tilt and depressions, and a maximum tolerance of 0.040 inches is permitted.

Even if the bowling lane does not suffer from the effects of changes in humidity, it still suffers damage from normal use. The constant impacts of the bowling balls on the lanes produce small depressions, which eventually must be repaired. The surface of the lane can be sanded down, and sanding is usually done about once every three years. The sanding operation can remove from one-sixteenth to one quarter of an inch from the lane.

Sanding of the lane creates its own problems. Because the area near the foul line does not normally suffer much damage due to impact from a bowling ball, this area is not usually sanded. But the repeated sanding of the remainder of the lane creates a slope in the lane. Eventually, the amount of the slope becomes unacceptable, and the lane cannot be sanded further. When this point is reached, it would be helpful to be able to invert the lane, so as to begin again with the surface which originally faced downward. But if, as is true in many of the structures of the prior art, the boards are nailed into their supporting structure, it is impossible to use the underside of the boards in this way.

When a bowling lane which has been damaged by feathering or by repeated impacts of a bowling ball can be sanded no more, it is necessary to replace the lane. This is an expensive undertaking. It currently costs several thousand dollars to replace one lane. The cost of replacing an entire set of lanes is therefore prohibitively high, even for a moderately sized bowling establishment.

It is possible to address the moisture problem by impregnating the boards with a glycol-type solution which extracts all moisture and air from the wood. This method will eliminate moisture from the boards, but the method is also very expensive. It is also possible to seal the individual boards against moisture with polyurethane, or another sealing material, but this procedure is also very expensive, and is not completely effective.

The present invention solves the problems described above, and provides an economical structure for a bowling alley, the alley having a greatly increased life expectancy, compared with the bolwing alleys of the prior art. The invention also facilitates the inversion of the boards of the lane, so that when one side if finally exhausted, it is possible and practical to use the previously unused surface of the lane. The invention also makes it easy to raise and lower parts of the lane so as to maintain the level character of the lane.

SUMMARY OF THE INVENTION

The present invention comprises a bowling alley having a lane which is formed of a plurality of narrow boards. The boards are prevented from moving vertically across each other by a suitable interlocking means, such as a torque-and-groove construction. The boards are held together, across the width of the lane, by a clamping means, the clamping means including a pair of angle members. Each of the boards has a series of holes, such that when the boards are held together, the holes define internal transverse channels through which a set of rods can be inserted. The ends of the rods are threaded, and inserted through the angle members. A pair of nuts are tightened around the ends of the rods, so that the angle members clamp the boards together. A resilient member, such as a flexible washer, is provided, preferably between each angle member and nut, the resilient member allowing expansion and contraction of the lane.

At least one pressure transducer is disposed on at least one of the rods, between the angle member and the net which is threaded onto the rod. The transducer generates an electrical signal proportional to the transverse displacement of the lane, and can be connected to a means for humidifying or dehumidifying the boards of the lane, as appropriate.

The bowling lane comprises a plurality of boards, laid end to end. The boards are staggered throughout the length of the lane, so that there are no seams extending across the entire lane. The lane is held above ground, and is supported by a plurality of C-beams, which in turn rest upon a set of posts. The posts are preferably anchored in concrete, on the ground, below the lane, but they can also be fastened to a wooden floor. The posts are provided with threaded extension members which can be used to adjust the height of the lane. The lane should be maintained at a height of about 12 inches from the ground, although this height can be varied.

A three-sided insulated wall is provided in the region beneath the lane. This wall, together with the lane itself, defines an enclosure in which atmospheric conditions can be monitored and controlled. At least one moisture sensor is provided, for directly measuring the moisture content of one or more of the boards, and the output of this sensor can be connected to a controller which activates a humidifying of dehumidifying device, as needed. The moisture sensor described above is in addition to the pressure transducers, which also provide indirect indications of the moisture content of the boards.

In an alternative embodiment, the tongue-and-groove interlocks are replaced with splines which fit within semicylindrical grooves formed in adjacent boards. When the boards are clamped together, the grooves deform slightly to form elliptical cross-sections, and the splines are made to fill the entire space within the grooves. This embodiment saves some material costs, by reducing the amount of wood that would be wasted in forming tongues in each board.

In another alternative construction, the rods can be replaced by metal wires or nylon cords, extending through holes in the boards, and attached to the angle members. The wires or cords pull the angle members together, providing clamping of the boards as before, and their natural flexibility permits the boards to expand and contract without damage.

It is therefore an object of the present invention to provide a bowling alley having a long life expectancy.

It is another object of the invention to provide a bowling alley having a lane which is vertically adjustable.

It is another object to provide a bowling alley wherein different portions of the lane can be raised and lowered.

It is another object of the invention to provide a bowling alley wherein the moisture content of the boards can be both directly and indirectly measured.

It is another object of the invention to provide a bowling alley which permits the boards forming the lane to expand and contract, without permanently damaging the boards.

It is another object of the invention to provide a bowling alley wherein the boards of the lane can be easily inverted, so that the boards which originally faced downward can be made to face upward.

It is another object to provide a bowling alley having a construction which does not require nails.

It is another object to provide a bowling alley, the components of which can be disassembled, board by board and bolt by bolt, and packaged for shipment.

Other objects and advantages of the invention will be apparent to those skilled in the art, from a reading of the following brief description of the drawings, the detailed description of the invention, and the appended claims.

DETAILED DESCRIPTION OF THE INVENTION

Figure 1:
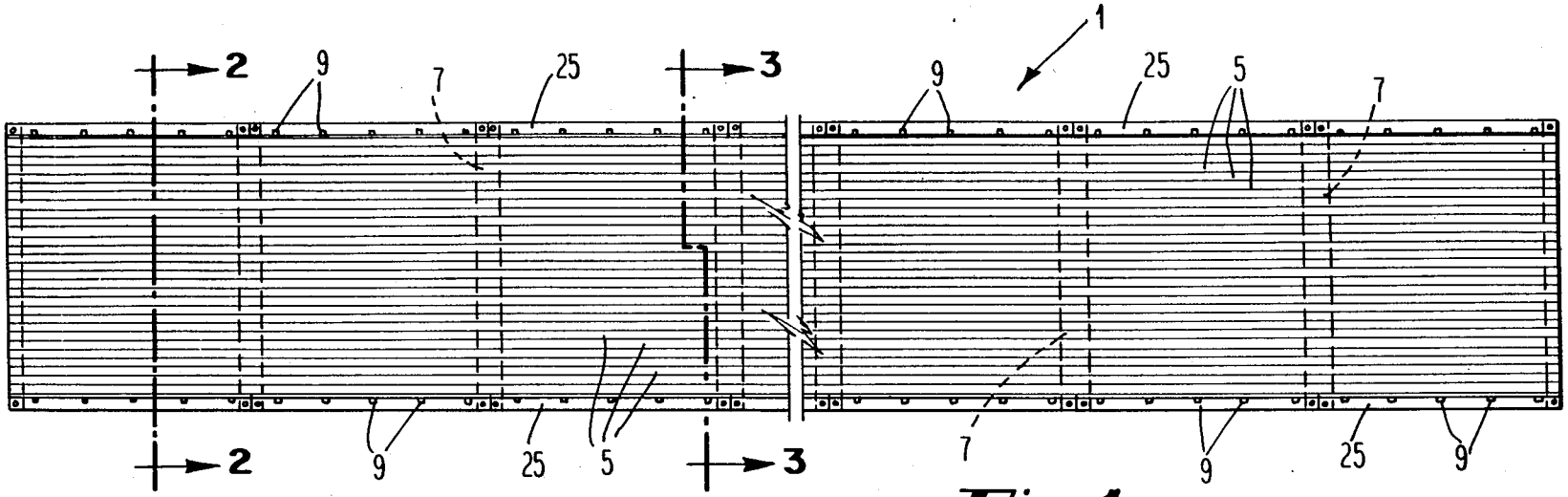
FIG. 1 is a plan view of the bowling alley of the present invention, showing the boards forming the lane, and indicating the position of the rods extending across the width of the lane.
Figure 2:
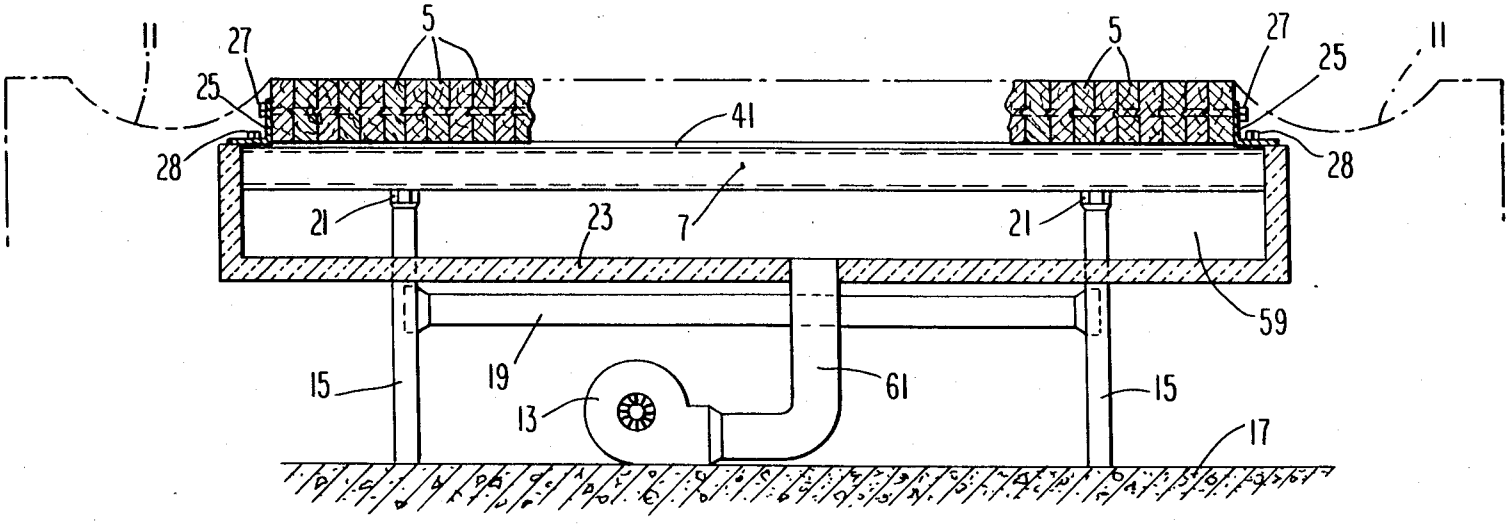
FIG. 2 is a cross-sectional view of the bowling alley, taken along the line 2—2 of FIG. 1, showing the structure of the alley beneath the bowling lane.
Figures 3, 3A:
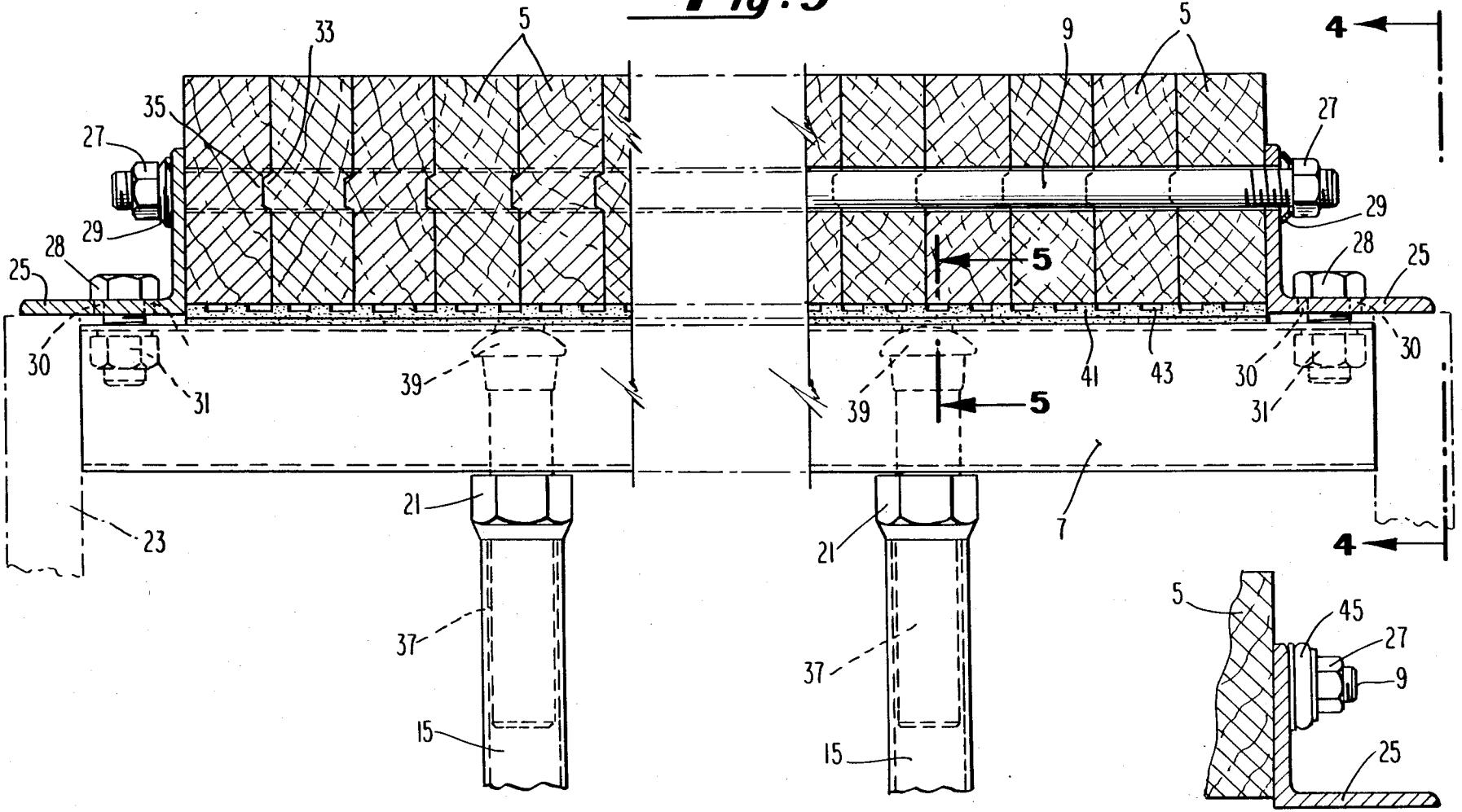
FIG. 3 is a cross-sectional view of the bowling alley, taken along the line 3—3 of FIG. 1, illustrating in detail the manner by which the boards are held together, and also illustrating the means of support for the boards.
FIG. 3*a* is a fragmentary cross-sectional view, showing a pressure transducer which indicates the amount of displacement of the bowling lane, due to changes in moisture content of the boards.
Figure 4:
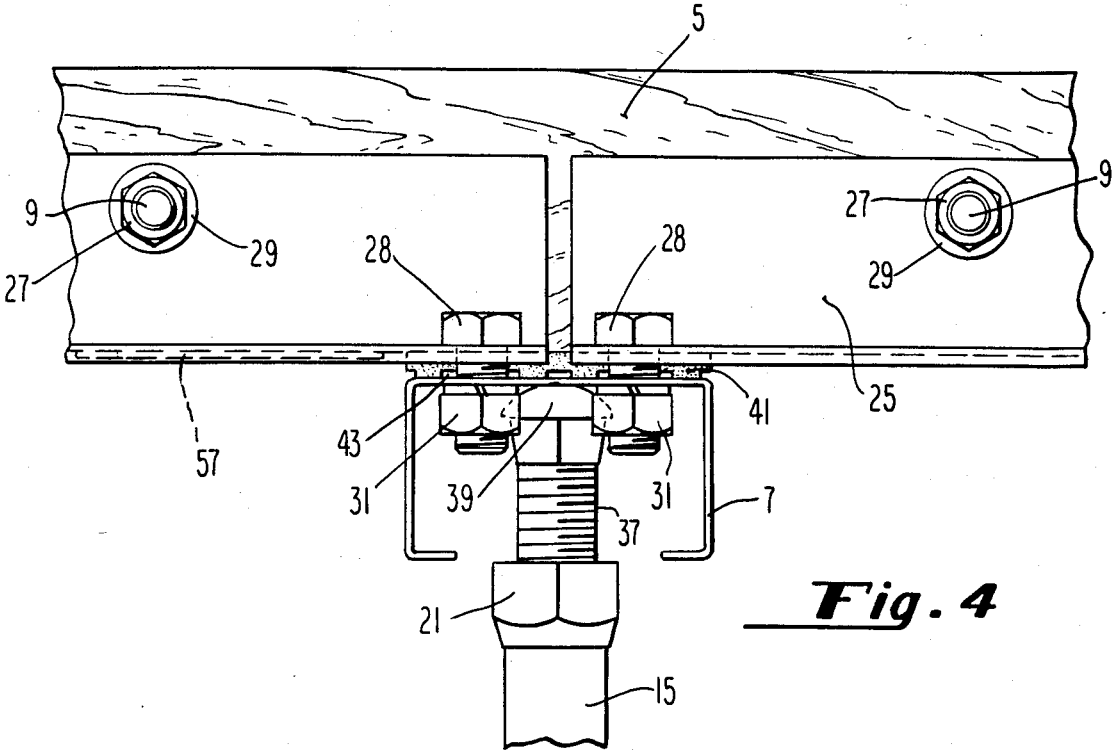
FIG. 4 is a fragmentary side elevational view, taken along the line 4—4 of FIG. 3, showing one of the C-beams which support the bowling lane.

The bowling alley of the present invention is shown in the plan view of FIG. 1, in the cross-sectional views of FIGS. 2 and 3, and in the elevational view of FIG. 4. Bowling alley 1 includes a bowling lane formed from a plurality of boards 5 laid end to end. The plan view of FIG. 1 shows the overall layout of the alley, but does not show the details of its construction. In practice, the boards 5 are staggered throughout the length of the lane, so that there are no seams extending across the entire width of the lane.

FIG. 3 illustrates the construction of the bowling alley in more detail. A plurality of boards 5 are held together between angle members 25. Boards 5 have tongues 33 and grooves 35, which hold the boards in a mating relationship, and which prevent the boards from moving vertically across each other. The boards are drilled with holes in precise locations, so that when the boards are held together to form the lane, the holes are aligned to provide a plurality of transverse internal channels through which rods, such as rod 9, can be inserted. The rod has threaded ends which are designed to receive nuts 27. The rod is inserted through the hole in the boards, and through the angle member 25, and the nuts 27 are screwed onto the ends of the rods. When the nuts are tightened, the angle members clamp the boards together. Resilient washers 29 are placed between angle members 25 and nuts 27. Washers 29 can be Bellville washers, or equivalent devices, which are rugged yet elastic. The washers 29 therefore allow the boards 5 to expand or contract slightly, in response to changes in the moisture content of the wood.

Angle members 25 are attached to C-beam 7, by bolts 28 and nuts 31. This attachment is such that the C-beam and the angle member cannot move apart vertically, but permits the C-beam and the angle member to slide across each other horizontally. The structure of the C-beam 7 is more clearly illustrated in FIG. 4, and will be described in more detail below.

The boards 5 rest on a flexible mat 41, made of rubber or similar material, the mat having a network of grooves 43, only some of which are visible in FIG. 3. The mat 41 rests on C-beam 7.

The C-beam is supported by posts 15, which includes a threaded extension member 37, a screw member 21, and a support 39. The support contacts the C-beam, and is welded thereto, as will be more fully described below. The posts are preferably made of steel, or other rigid material.

Slot 30 is formed in angle member 25. The slot allows the angle member to slide laterally, to a limited degree, in response to expansion of the boards 5. The apparatus therefore accommodates changes in moisture content of the boards in two ways. The washer 29 permits the vertical portion of angle member 25 to move, and the entire angle member can slide around bolt 28. Nut 31 can be a conventional locknut, having a plastic insert to facilitate the movement of the angle member along the C-beam.

As shown in FIG. *3a*, pressure transducers 45 are disposed around the rods, between some of the angle members 25 and their associated nuts 27. For the sake of clarity, FIG. *3a* does not also show the washer, but it is understood that all the rods have such washers, or their equivalent.

Transducers 45 can be a conventional strain gauge which generates an electrical signal in response to changes in the pressure exerted by the boards. The output of transducer 45 is therefore an indirect indication of the level of moisture in the boards. Many different types of such transducers are commercially available. Most of the angle members 25 do not have such transducers, however. It is preferable that there be one transducer approximately every fifteen feet along the lane.

The output of the transducer can be displayed on a meter, or by any other conventional display means. The output of the transducer can also be used to control automatically a humidifier and a dehumidifier. The moisture level in the wood should correspond to a relative atmospheric humidity level of about 50%.

The structure of the C-beam, and of the angle members, is more clearly shown in the elevational view of FIG. 4. FIG. 4 shows one of the boards 5, and adjacent angle members 25. C-beam 7 is shown attached to the angle members by bolts 28 and nuts 31. FIG. 4 also shows the rubber mat 41, and shows the grooves 43 formed in the mat. Also shown in FIG. 4 is post 15, with its screw member 21, extension member 37, and support 39. Also visible are nuts 27 and rods 9, as well as washers 29.

Figure 5:
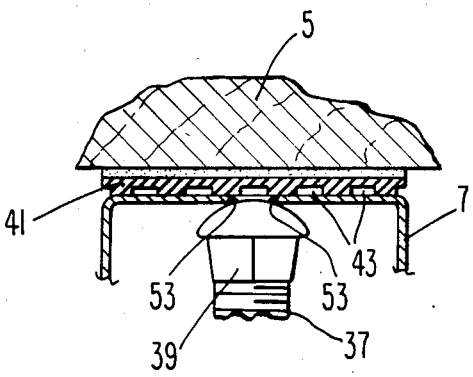
FIG. 5 is a fragmentary cross-sectional view, taken along the line 5—5 of FIG. 3, illustrating the junction of the post, which supports the lane, and the C-beam.

FIG. 5 illustrates more details of the means of support for the bowling lane. Extension member 37 is shown, in fragmentary form, and the support 39 is shown welded to C-beam 7, at weld points 53. FIG. 5 also illustrates the flexible mat 41, and shows the grooves 43 in the mat. As stated above, the mat has a network of grooves, the grooves running both longitudinally and transversely. The longitudinal grooves are shown in FIG. 3; the transverse grooves, in FIG. 4. It is also possible to construct the mat without any grooves at all.

The rod and washer structure shown in FIG. 3 is not the only possible configuration. In an alternative embodiment, the rods 9 can be replaced by flexible wires or nylon cords which are strung between the angle members 25. The wires or cords are placed in tension between the angle members, and hold the boards 5 tightly together. The wires or cords can expand and contract with small changes in the width of the lane. In this embodiment, washers 29 are eliminated. What is important is that there be some flexible member to enable the boards to expand and contract without forming gaps between adjacent boards.

The structure of the bowling alley, beneath the lane, is shown more fully in FIG. 2. The figure shows the lane defined by boards 5, flanked by gutters 11. Posts 15 are embedded in concrete material 17, and are braced by cross bars 19. The posts can also be fastened to a wooden floor, to suit the needs of a particular installation. An insulated three-sided wall 23, together with the boards themselves, defines an enclosed region 59 beneath the boards 5. An atmosphere regulator 13, which can include both a conventional air conditioner and a humidifying unit, is disposed below the lane, and supplies humidifier or dehumidifier air to region 59, through duct 61. The insulation in wall 23 can be fiberglass, or any other equivalent product. Air circulating through region 59 is made to flow along substantially the entire length of the alley, so as to maintain the proper moisture levels for all of the boards 5.

The structure shown in FIG. 2 illustrates another advantage of the invention, as compared with the prior art. In bowling alleys of the prior art, the lane is generally supported by wooden cribbing, formed of boards which are nailed together. The structure disclosed herein requires no nails, and facilitates the assembly and disassembly of the alley. Moreover, different portions of the lane can be raised or lowered slightly, by adjusting the various screw members 21. Thus, it is possible to compensate somwhat for slopes in the lane due to sanding.

Figure 6:
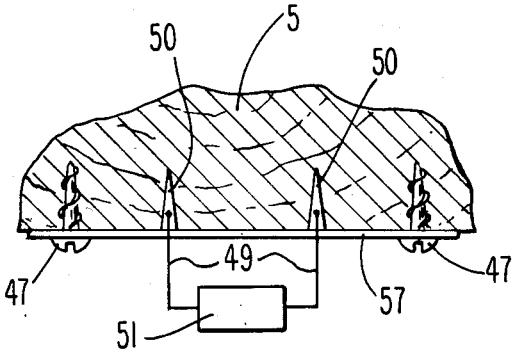
FIG. 6 is a fragmentary cross-sectional view showing a device for directly sensing the moisture content of the boards forming the bowling lane.

Atmosphere regulator 13 is controlled by a signal from a moisture indicator attached directly to one or more of the boards 5. FIG. 6 shows one possible design for the moisture indicator. The indicator comprises plate 57 having sensor pins 50. Plate 57 is inserted, with its pins, into one of the boards 5, and the plate is fastened to the board by wood screws 47. Leads 49 carry an electric current, and the electrical resistance of the wood is measured, and translated into a reading of its moisture content. This reading can be processed by controller 51, which is connected, by conventional circuitry, to activate the atmosphere regulator 13.

The moisture sensor represented by pins 50 and controller 51 is in addition to, and is independent of, the pressure transducers 45. Both the transducers and the moisture sensor provide indications of the moisture content of the wood, and their outputs can be displayed on a meter, a computer screen, or by any other means, to inform the operator of the bowling alley of the condition of the alley. The outputs of these devices can be connected, in parallel, to control the regulator 13, to correct for extremes in moisture content of the wood. It is understood that other types of moisture sensors can be used.

Figure 7:
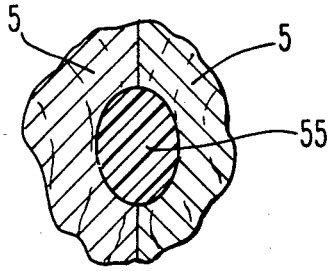
FIG. 7 is a fragmentary cross-sectional view showing an alternative construction for the boards, wherein the boards are joined by splines.

FIGS. 2 and 3 illustrate a tongue-and-groove interconnection of the boards 5. An alternative means of connecting the boards is illustrated in the fragmentary view of FIG. 7. Instead of tongues and grooves, the boards 5 are provided with recesses, having generally semi-elliptical cross-sections, into which splines 55 are inserted. When the boards are compressed over the splines, the splines are deformed into a generally elliptical cross-section, conforming to that of the recess, as shown in FIG. 7.

An elliptical recess is necessary because it is very difficult, if not impossible, to construct a spline of circular cross-section which will fill exactly all of the space within a cylindrical space. With the elliptical construction shown, the spline is made to fill all the space when the boards are compressed. The embodiment of FIG. 7 has the advantage of saving some material, insofar as the boards do not need to be planed down to form tongues. This embodiment can eliminate several boards from each lane, amounting to a significant saving for large bowling establishments.

Alternative means for connecting the boards can also be used. For example, the space within the recesses can be filled with an initially soft plastic material which hardens with the passage of time. What is important is that the boards not be allowed to move vertically across each other.

The present invention makes it comparatively easy to invert the bowling lane, and to use the previously unused surface. It is only necessary to unfasten the bolts 28 when performing this operation. The entire lane can be lifted up, without loosening the nuts 27, or other means of fastening, and can be turned over in one operation. The angle members 25 can be rotated about the rods 9, and reattached to the C-beams 7 by bolts 28 and nuts 31. This operation is made simple by the fact that the boards of the lane are not nailed or otherwise directly fastened to the supporting C-beams, but merely rest upon the C-beams. The boards are connected firmly to the C-beams through the bolts which join the angle members to the C-beams, but these bolts can be removed and refastened with comparative ease.

The bowling alley disclosed has the additional advantage that it can be disassembled, bolt by bolt, and board by board, and packed for shipment. Because no nails are required for holding the boards together, or for constructing the supporting structure beneath the lane, it is possible to dismantle the entire alley without damage to its components. The disassembly process involves mainly the loosening of nuts, such as nuts 31. The individual boards can also be disassembled, by unfastening nuts 27. The alley can easily be reassembled, again without substantial harm to any of its parts.

In the present invention, the flexible washer, or other equivalent flexible member, is provided to permit expansion of the boards in the transverse direction. It turns out that changes in the size in the longitudinal direction are not a serious problem, and it is not necessary to provide means for relieving longitudinal stresses.

The bowling alley described will last far longer than those of the prior art. Because the boards are protected from damage from separation due to moisture, each lane lasts much longer. And because the lane can be inverted, the life of the alley is prolonged even more. It is apparent that the alley described above will last more than twice as long as conventional bowling alleys.

While the invention has been described with respect to the particular embodiments illustrated, it is understood that the invention can be modified in many ways. As stated above, another type of resilient means can be substituted for the flexible washer which allows the boards of the lane to expand. A nylon cord or wire can be substituted, as described above. The resilient means could even by a hydraulic or pneumatic cylinder.

The means of attachment of the boards to each other can be varied. The placement, types, and numbers of the pressure sensors can be changed, and the invention can be used with or without the additional moisture sensor which is shown connected directly to the wood. These and other modifications are to be deemed within the spirit and scope of the following claims.

What is claimed is:

1. A bowling alley, comprising:

(a) a plurality of boards, each of the boards having holes, the boards being held together between two angle members, to form a bowling lane, the boards being held so that the holes are aligned to form channels extending through the boards, (b) at least one rod disposed within a channel, the rod extending through holes in the angle members, the rod having nut means disposed on both ends of the rod, wherein the tightening of the nut means along the rod causes the angle members to clamp the boards together, wherein there is at least one resilient member, disposed on the rod, the resilient member permitting expansion and contraction of the boards, (c) the boards and rods being supported on a plurality of horizonally disposed beams, (d) the beams being held by a plurality of vertical support means, the beams being held in an elevated position above the ground, the vertical support means including vertically adjustable extension means for varying the height of the beams above the ground, (e) enclosure means defining an insulated region beneath the boards, and means for regulating the atmosphere in said region, and (f) means for monitoring the humidity levels in the boards, the monitoring means being connectable to the atmosphere regulating means.

2. The bowling alley of claim 1, wherein the monitoring means comprises a strain gauge, connected to measure the pressure exerted by the boards against the angle member.

3. The bowling alley of claim 2, further comprising means for directly sensing the moisture content of the boards, the sensing means being connectable to the atmosphere regulating means.

4. The bowling alley of claim 3, wherein the resilient member comprises a convex metallic washer.

5. The bowling alley of claim 4, wherein the boards are formed with tongues and grooves, wherein the boards are held together in generally mating relationship.

6. The bowling alley of claim 4, wherein the boards are formed with recesses, the recesses being shaped to hold a spline, the boards being held over a plurality of splines.

7. A bowling alley, comprising:

(a) a plurality of boards, and means for holding the boards tightly together to form at least part of a bowling lane, the boards being mounted on a frame, (b) rod means, extending through the lane, the ends of the rod means being connected to the holding means, the rod means and the holding means being the sole means of attaching the boards to the frame, and (c) spring means for allowing the boards of the lane to expand and contract within the holding means, in response to small changes in the size of the boards, the spring means being substantially uniformly resilient about the circumference of the rod means.

8. The bowling alley of claim 7, wherein the lane is supported by a plurality of posts.

9. The bowling alley of claim 8, wherein each post includes a vertically adjustable extension member, wherein adjustment of the extension member can vary the height of the lane.

10. A bowling alley, comprising:

(a) a plurality of boards, and means for holding the boards tightly together to form at least part of a bowling lane, (b) rod means, extending through the lane, the ends of the rod means being connected to the holding means, and (c) spring means for allowing the boards of the lane to expand and contract within the holding means, in response to small changes in the size of the boards, wherein the lane is supported by a plurality of posts, wherein each post includes a vertically adjustable extension member, wherein adjustment of the extension member can vary the height of the lane, and wherein at least some of said rod means have pressure sensing means, disposed on the rod means, for monitoring the pressure between the boards and the holding means.

11. The bowling alley of claim 10, further comprising an insulated wall means, disposed beneath the boards of the lane, the wall means and the boards defining a substantially closed region adjacent the boards.

12. The bowling alley of claim 11, including atmosphere regulation means, connected to regulate the condition of the air in said closed region.

13. The bowling alley of claim 12, further comprising at least one moisture sensor, the moisture sensor being connected to at least one of the boards, the output of the moisture sensor being connectable to the atmosphere regulation means.

14. The bowling alley of claim 13, wherein the output of the pressure sensing means is connectable to the atmosphere regulation means, whereby the atmosphere in the closed region can be controlled in response to changes in the moisture content of the boards.

15. The bowling alley of claim 14, wherein the holding means comprises a pair of angle members, wherein the rod means are threaded and inserted through holes in the angle members, the holding means further comprising a pair of nut means, the nut means being threaded onto the rod means, wherein the tightening of the nut means causes the angle members to clamp the boards.

16. The bowling alley of claim 15, wherein the spring means comprises a flexible metallic washer, the washer being disposed on the rod means between the angle member and the nut means.

17. The bowling alley of claim 16, wherein the angle members are attached to a plurality of C-beams, the C-beams being adapted to rest upon the posts.

18. The bowling alley of claim 17, wherein the angle members are slotted to allow some lateral movement of the angle members in response to expansion and contraction of the boards held between the angle members.

19. The bowling alley of claim 18, wherein the boards have tongues and grooves, and wherein the boards are held together in interlocking relationship by said tongues and grooves.

20. The bowling alley of claim 18, wherein the boards have recesses, and wherein the boards are held together in interlocking relationship by a plurality of splines inserted within said recesses.

21. An improved bowling alley comprising a plurality of boards, the boards being held firmly together by a clamping means, to define a bowling lane, wherein the clamping means includes resilient means for permitting the boards to expand and contract in the trasverse direction, while maintaining a transverse clamping pressure on the boards, the boards thereby being prevented from moving apart and forming gaps, due to changes in their moisture content, the lane being held above the ground level, the lane being supported on a plurality of vertically adjustable support members, the lane being fastened to its support members only by nut and bolt means, wherein the lane is readily removable from the support members, the bowling alley further comprising wall means, located beneath the lane, the wall means and the lane defining a substantially closed region within which the atmosphere can be controlled, and further comprising at least one means for measurement of the moisture content of the boards.

22. The bowling alley of claim 21, wherein the measurement means is connected to atmosphere regulating means for regulating the atmospheric conditions in said region.

23. An improved bowling alley comprising a plurality of boards, the boards being held firmly together by a plurality of clamping means, to define a bowling lane, the clamping means including resilient means for permitting the boards to expand and contract in the transverse direction, without forming gaps between adjacent boards, at least one of the clamping means including pressure sensing means for monitoring the transverse pressure exerted by the boards, the lane being held above the ground level on a plurality of vertically adjustable supports.

24. The bowling alley of claim 23, further comprising means for regulating the atmosphere near the boards, the atmosphere regulating means being connected for actuation by the pressure sensing means, wherein the atmosphere regulating means is connected to decrease the atmospheric humidity when the pressure of the boards is high, due to excessive moisture in the boards, and wherein the atmospheric regulating means is connected to increase the atmospheric humidity when the pressure of the boards is low, due to insufficient moisture in the boards.

25. A bowling alley, comprising:

(a) a plurality of boards, and means for holding the boards tightly together to form at least part of a bowling lane, the boards being mounted on a frame, (b) rod means, extending through the lane, the ends of the rod means being connected to fastening means, the fastening means being connected around the holding means, wherein the holding means are urged towards the boards so as to compress the boards together, and wherein the rod means and fastening means are the sole means of attachment of the boards to the frame, and (c) spring means for allowing the boards of the lane to expand and contract within the holding means, in response to small changes in the size of the boards, the spring means being substantially uniformly resilient about the circumference of the rod means.

26. An improved bowling alley comprising a plurality of boards, the boards being held firmly together by a clamping means, to define a bowling lane, wherein the clamping means includes resilient means for permitting the boards to expand and contract in the transverse direction, while maintaining a transverse clamping pressure on the boards, the resilient means imparting substantially uniform resilience between the clamping means and the boards such that the boards can maintain their substantially parallel orientation as they expand and contract, the boards thereby being prevented from moving apart and forming gaps, due to changes in their moisture content, the lane being held above the ground level, the lane being supported on a plurality of vertically adjustable support members, each of the support members being anchored in the ground, such that the vertical position of one portion of the lane can be adjusted independently of that of another portion of the lane.

27. The bowling alley of claim 26, the lane being fastened to its support members by nut and bolt means, wherein the nut and bolt means are the sole means of fastening the lane to the support members, and wherein the lane is readily removable from the support members.

28. An improved bowling alley comprising a plurality of boards, the boards being held firmly together by a clamping means, to define a bowling lane, wherein the clamping means includes resilient means for permitting the boards to expand and contract in the transverse direction, while maintaining a transverse clamping pressure on the boards, the boards thereby being prevented from moving apart and forming gaps, due to changes in their moisture content, the lane being held above the ground level, the lane being supported on a plurality of vertically adjustable support members, each of the support members being anchored in the ground, such that the vertical position of one portion of the lane can be adjusted independently of that of another portion of the lane, the lane being fastened to its support members by nut and bolt means, wherein the nut and bolt means are the sole means of fastening the lane to the support members, and wherein the lane is readily removable from the support members, and further comprising insulated wall means, located beneath the lane, the wall means and the lane defining a substantially closed region within which the atmosphere can be controlled.

29. The bowling alley of claim 28, further comprising means for circulating air through said region.

* * * * *